US007073547B1

(12) United States Patent
Carlson

(10) Patent No.: US 7,073,547 B1
(45) Date of Patent: Jul. 11, 2006

(54) LATEX PAINT CLEAN-UP LIQUID DISPOSAL DEVICE

(76) Inventor: Steve Carlson, 374 Cameo Dr., Danville, CA (US) 94526

( * ) Notice: Subject to any disclaimer, the term of this patent is extended or adjusted under 35 U.S.C. 154(b) by 0 days.

(21) Appl. No.: 11/087,783

(22) Filed: Mar. 23, 2005

Related U.S. Application Data

(60) Provisional application No. 60/556,081, filed on Mar. 25, 2004.

(51) Int. Cl.
*B65B 1/04* (2006.01)

(52) U.S. Cl. ..... 141/364; 141/331; 4/319

(58) Field of Classification Search ..... 141/364, 141/98, 331–345; 4/319
See application file for complete search history.

(56) References Cited

U.S. PATENT DOCUMENTS

| | | | | | |
|---|---|---|---|---|---|
| 421,754 | A * | 2/1890 | Pannill | 141/106 |
| 3,564,619 | A * | 2/1971 | Magathan | 4/319 |
| 3,732,593 | A | 5/1973 | Habostad | |
| 3,837,035 | A | 9/1974 | Habostad | |
| 4,092,745 | A * | 6/1978 | Oropallo | 4/288 |
| 4,546,900 | A | 10/1985 | Lackey | |
| 4,668,384 | A | 5/1987 | Holman | |
| 4,809,722 | A | 3/1989 | Pennise | |
| 5,172,739 | A * | 12/1992 | Ristroph | 141/98 |
| 5,183,280 | A | 2/1993 | Gresch | |
| 5,409,027 | A | 4/1995 | Glunt | |
| 5,528,776 | A | 6/1996 | Carmichael | |
| 5,641,007 | A * | 6/1997 | Falk | 141/106 |
| 5,961,006 | A | 10/1999 | Dunham et al. | |
| 6,578,590 | B1 | 6/2003 | Leblond | |
| 2004/0206380 | A1 | 10/2004 | Wallace, III | |

* cited by examiner

*Primary Examiner*—Steven O. Douglas
(74) *Attorney, Agent, or Firm*—Thomas R. Lampe

(57) ABSTRACT

A device is employed with sewer inlet structure including a conduit leading to a sewer line to dispose of clean-up liquid including water and latex paint. The device includes a container engageable with and supported by the sewer inlet structure and a drain pipe leading from the container to the interior of the conduit. Engagement between the drain pipe and inner surface of the conduit will limit both sideways displacement and tipping of the container.

1 Claim, 2 Drawing Sheets

LATEX PAINT CLEAN-UP LIQUID DISPOSAL DEVICE

This application is based on and claims the benefit of U.S. Provisional Patent Application No. 60/556,081, filed Mar. 25, 2004.

TECHNICAL FIELD

This invention relates to a device for disposing of clean-up liquid including water and latex paint into a sewer line.

BACKGROUND OF THE INVENTION

Most jurisdictions allow for the disposal of clean-up water from latex paints into a sewer system. This practice is ecologically sound and is far preferable to dumping the clean-up liquid onto the ground, which can cause soil contamination.

As will be seen below, the device disclosed and claimed herein provides a means for readily and quickly introducing clean-up liquid, including water and latex paint, into a sewer line. Tools, for example brushes and rollers, spray equipment, etc. can be cleaned directly in the bucket of the device and the waste water from the cleaning operation directly dumped into the sewer. This operation is quickly and readily accomplished without the danger of soil contamination. A search of the prior art has failed to locate any devices dedicated to or specifically suitable for introducing clean-up water from latex paints into a sewer system, so as to prevent soil contamination.

The following patents and patent publications disclose various types of apparatus for temporarily holding and discharging liquids, some associated with paints and/or cleaning liquids: U.S. Pat. No. 4,668,384, issued May 26, 1987, U.S. Pat. No. 5,961,006, issued Oct. 5, 1999, U.S. Pat. No. 5,183,280, issued Feb. 2, 1993, U.S. Pat. No. 4,546,900, issued Oct. 15, 1985, U.S. Pat. No. 6,578,590, issued Jun. 17, 2003, U.S. Pat. No. 5,409,027, issued Apr. 25, 1995, U.S. Pat. No. 3,732,593, issued May 15, 1973, U.S. Pat. No. 3,837,035, issued Sep. 24, 1974, U.S. Pat. No. 4,809,722, issued Mar. 7, 1989, U.S. Pat. No. 5,528,776, issued Jun. 25, 1996, and U.S. Patent Application Publication No. US 2004/0206380, dated Oct. 21, 2004.

There is no teaching or suggestion in the located prior art of the structural components of the invention disclosed and claimed herein or the cooperative relationships therebetween.

DISCLOSURE OF INVENTION

The present invention relates to a device positionable on sewer inlet structure including a conduit leading to a sewer line to dispose of clean-up liquid including water and latex paint. The device includes a container having a container interior and a container bottom defining an opening in fluid-flow communication with the container interior.

The container bottom has a sewer inlet structure engagement surface surrounding the opening and projecting outwardly therefrom. The sewer inlet structure engagement surface is for engagement with the sewer inlet structure to support the device.

The device also includes a drain pipe defining a passageway.

The drain pipe is connected to the container with the drain pipe extending downwardly from the container bottom and the passageway of the drain pipe in fluid-flow communication with the container interior.

The drain pipe has an open distal end positionable in the conduit when the sewer inlet structure engagement surface is in engagement with the sewer inlet structure and the device supported thereby to allow discharge of clean-up liquid including water and latex paint from the container interior through the opening, through the passageway and out of the open distal end of the drain pipe into the sewer line.

Other features, advantages and objects of the present invention will become apparent with reference to the following description and accompanying drawings.

BEST MODE FOR CARRYING OUT THE INVENTION

Figure 3:
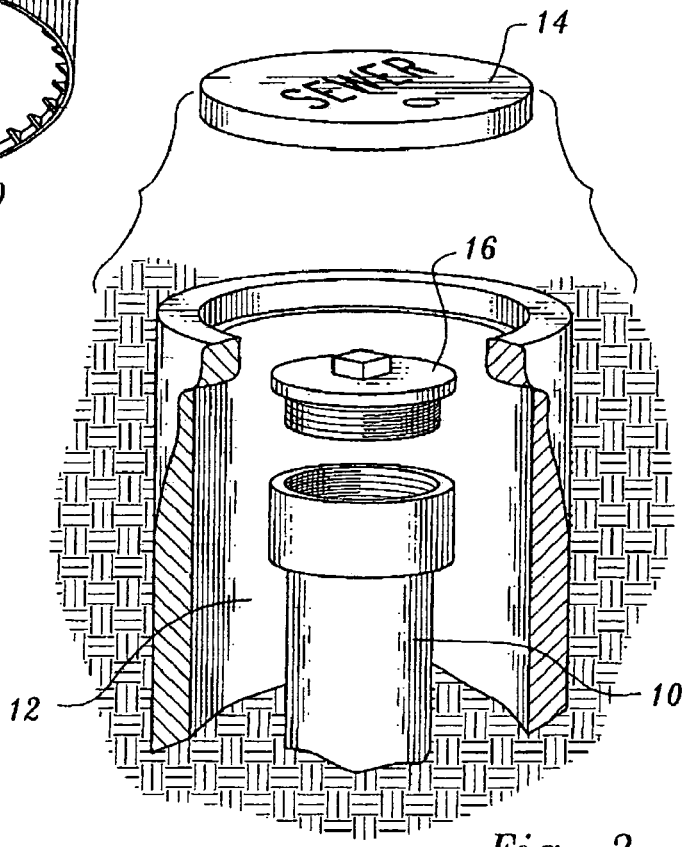
FIG. 3 is an exploded view illustrating typical sewer inlet structure, including a conduit leading to a sewer line, with which the device is to be utilized.
Figure 4:
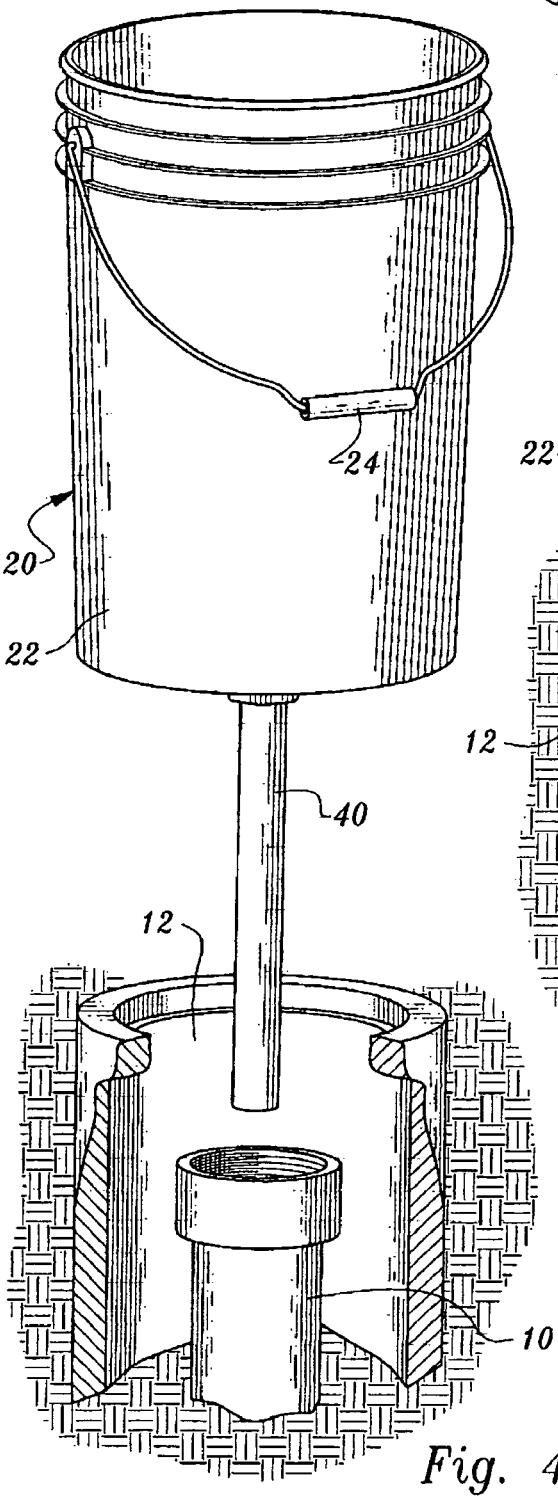
FIG. 4 shows the device located above the sewer inlet structure and prior to lowering of the device into engagement with the sewer inlet structure.
Figure 5:
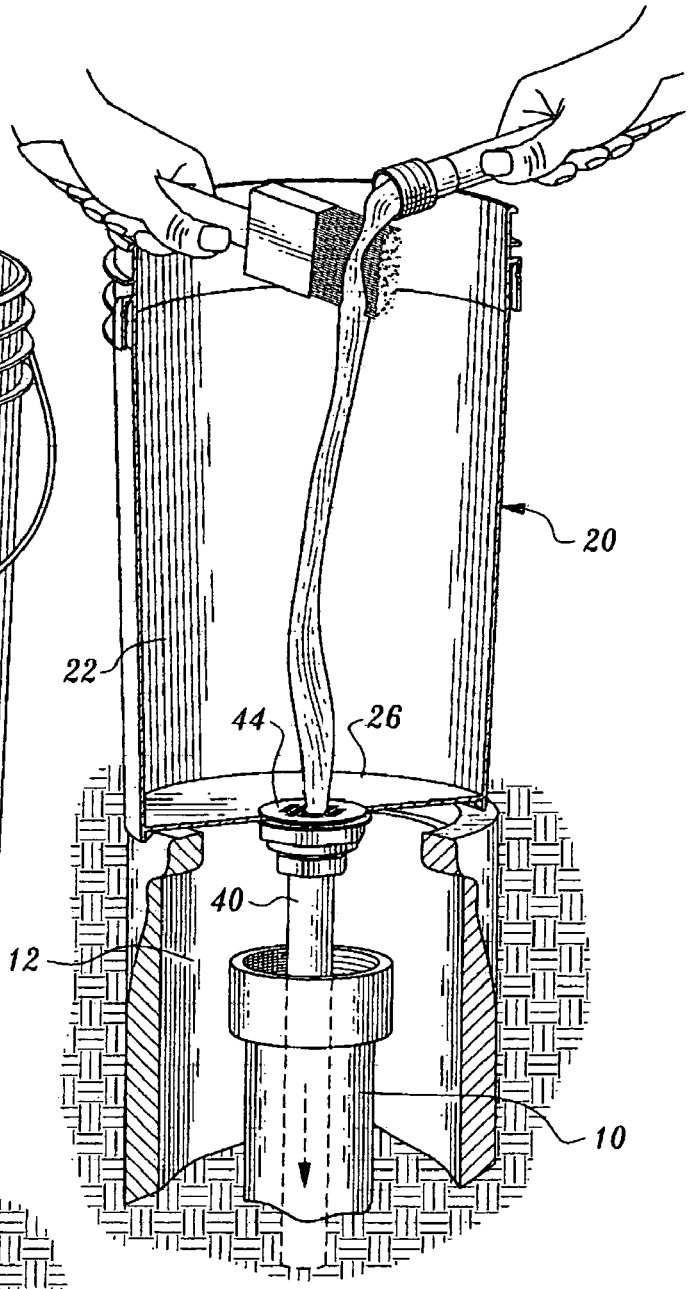
FIG. 5 shows the device supported by the sewer inlet structure, with clean-up liquid including water and latex paint being removed from a brush and exiting the device into the conduit of the sewer inlet structure leading to a sewer line to dispose of the clean-up liquid.

Referring now to the drawings, FIGS. 3, 4 and 5 illustrate components of a typical sewer inlet structure with which the device of the invention can be utilized. The device can be employed with other configurations and types of sewer inlet structures. In this instance, the sewer inlet structure is in the nature of a sewer clean-out including conduit 10 leading to a sewer line (not shown). Another component of the clean-out is a housing 12 positioned in the ground and surrounding the conduit 10. Closures 14, 16, respectively, selectively close the housing and conduit, such closures being removed as shown in FIG. 3 to allow use of the device.

Device 20 includes a container 22 which in the illustrated embodiment is in the nature of a five gallon plastic bucket having a handle 24.

The container has a container interior and a container bottom 26, the latter defining an opening 28 in fluid-flow communication with the container interior.

The container also has a sewer inlet structure engagement surface 30 which is the underside of the container bottom surrounding the opening and projecting outwardly therefrom. As will be seen below, the sewer inlet structure engagement surface is engageable with the sewer inlet structure to support and stabilize the device during use.

The device also includes a drain pipe 40 defining a passageway. The drain pipe is, in the arrangement shown, a section of rigid plastic pipe, such as schedule 40 ABS plastic pipe.

A connector 44 connects the drain pipe to the container with the drain pipe extending downwardly from the container bottom and the passageway of the drain pipe in fluid-flow communication with the container interior. The drain pipe 40 has an open distal end 46 positionable in the conduit 10 when the sewer inlet structure engagement surface 30 is in engagement with the sewer inlet structure and the device supported thereby to allow discharge of clean-up liquid including water and latex paint from the container interior through the opening, through the passageway and out of the open distal end of the drain pipe into the sewer line.

FIG. 5 shows the device supported by the housing 12 of the sewer inlet structure. Some clean-out installations exist wherein there is no housing for the conduit 10. In such an arrangement, the lower surface of the bottom 46 (the sewer inlet structure engagement surface) will engage the top of the conduit per se. In FIG. 5 the clean-up liquid being discharged into the sewer is a combination of latex paint being removed from a brush within the confines of the container and water from an ordinary garden hose.

The rigid drain pipe is engageable with the inner surface of the conduit 10 when positioned thereon to limit lateral displacement of the container relative to the sewer inlet structure when the inlet engagement surface is in engagement with the sewer inlet structure and the device is supported thereby. Thus, the person performing the cleaning operation has both hands free during the process. The conduit will limit both sideways displacement and tipping of the bucket.

Figure 2:
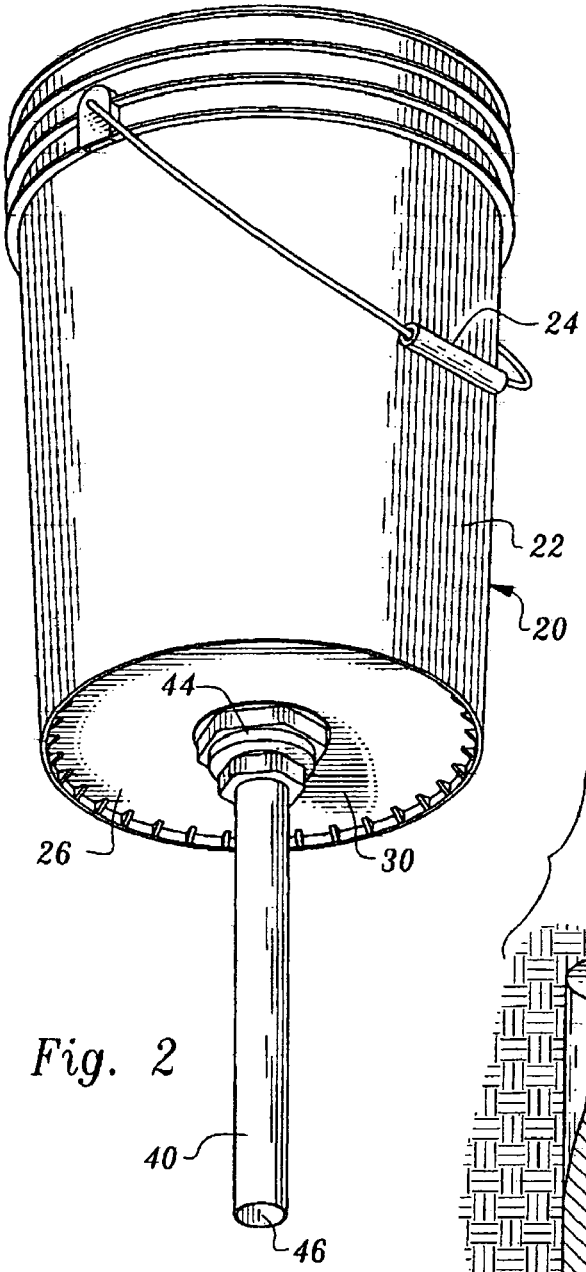
FIG. 2 is a bottom, perspective view of the device.
Figure 1:
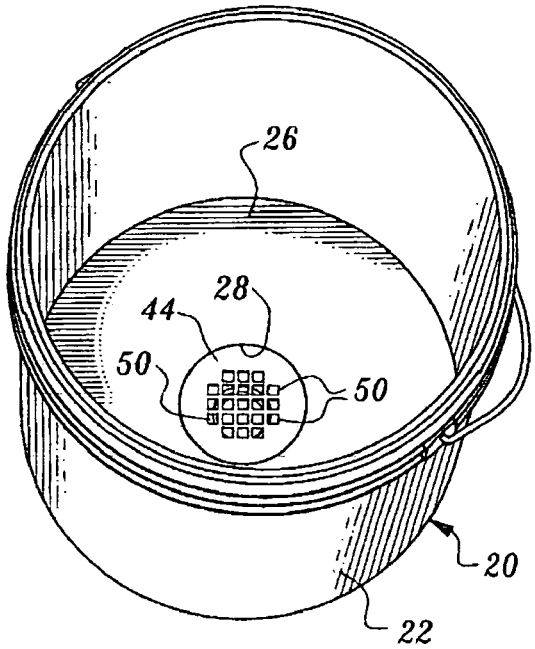
FIG. 1 is a top, perspective view of a preferred form of device constructed in accordance with the teachings of the present invention.

In the arrangement illustrated, the connector 44 is in the nature of a two inch fiberglass shower base drain secured by adhesive or any other suitable means to the container and the drain pipe. The connector, as shown, defines spaced drain openings 50 (see FIG. 1) positioned at the container bottom within the confines of the opening 28 for preventing solids above a certain size from exiting the container into the conduit.

The invention claimed is:

1. In combination:

sewer inlet structure having an upper end and including a conduit leading to a sewer line; and a device for discharging clean-up liquid including water and latex paint into said sewer line through said sewer inlet structure, said device including a container comprising a bucket having a container interior and a container bottom defining an opening in fluid-flow communication with said container interior, said container bottom having a sewer inlet structure engagement surface surrounding said opening and projecting outwardly therefrom, said sewer inlet structure engagement surface in engagement with the top end of the sewer inlet structure to support said device, said sewer inlet engagement structure projecting outwardly from said sewer inlet structure and not fixedly attached thereto, and a drain pipe defining a passageway connected to said container with said drain pipe extending downwardly from said container bottom and the passageway of said drain pipe in fluid-flow communication with said container interior, said drain pipe having an open distal end positioned in said conduit below the top end of the sewer inlet structure to allow discharge of clean-up liquid including water and latex paint from said container interior through said opening, through said passageway and out of the open distal end of said drain pipe into said sewer line, said drain pipe being rigid and of a size and configuration to engage an inner surface of said conduit to stabilize the container on said sewer inlet structure and maintain it in position on the top end of the sewer inlet structure by limiting lateral displacement of said container relative to said sewer inlet structure and resisting tipping of said container relative to said sewer inlet structure, said device additionally comprising a connector connecting said drain pipe to said container, said connector defining spaced drain openings positioned at said container bottom within the confines of said opening for preventing solids above a predetermined size from exiting said container into said conduit.

* * * * *